US008893879B2

(12) United States Patent
Scribner

(10) Patent No.: US 8,893,879 B2
(45) Date of Patent: Nov. 25, 2014

(54) EYEGLASS STORAGE CASE

(71) Applicant: James Robert Scribner, Sun Valley, CA (US)

(72) Inventor: James Robert Scribner, Sun Valley, CA (US)

( * ) Notice: Subject to any disclaimer, the term of this patent is extended or adjusted under 35 U.S.C. 154(b) by 0 days.

(21) Appl. No.: 14/132,261

(22) Filed: Dec. 18, 2013

(65) Prior Publication Data

US 2014/0190840 A1 Jul. 10, 2014

Related U.S. Application Data

(60) Provisional application No. 61/749,685, filed on Jan. 7, 2013.

(51) Int. Cl.
*A45C 11/04* (2006.01)

(52) U.S. Cl.
CPC ..... *A45C 11/043* (2013.01)
USPC ..... 206/5; 206/6

(58) Field of Classification Search
USPC ..... 206/5, 6, 37, 525.1; 2/12, 13, 15, 426; 150/154; 190/107; 383/119
See application file for complete search history.

(56) References Cited

U.S. PATENT DOCUMENTS

| | | | | | |
|---|---|---|---|---|---|
| 3,276,572 | A * | 10/1966 | Everburg | ..... | 206/5 |
| 4,823,943 | A * | 4/1989 | Chang | ..... | 206/5 |
| 5,032,019 | A * | 7/1991 | Burchett | ..... | 206/5 |
| 5,673,788 | A * | 10/1997 | McLane | ..... | 206/5 |
| 7,770,721 | B2 * | 8/2010 | Orner | ..... | 206/5 |
| 8,151,374 | B2 * | 4/2012 | Wilcox | ..... | 206/5 |
| 8,267,580 | B2 * | 9/2012 | Schneider | ..... | 383/119 |
| 2009/0000964 | A1 * | 1/2009 | Orner | ..... | 206/5 |

* cited by examiner

*Primary Examiner* — Luan K Bui
(74) *Attorney, Agent, or Firm* — Plager Schack LLP

(57) ABSTRACT

An eyeglass storage case conforms to contours of the eyeglass in a supported position and allows a user to slidably remove the eyeglass from the case. The storage case includes a rectangular sheet with a top half and a bottom half, the top half being mechanically coupled to the bottom half to create a pocket within the rectangular sheet, a support structure disposed within the pocket of the rectangular sheet and having a metallic bar affixed to both a support card and a support layer, a fastener strip mechanically coupled to the bottom half of the sheet, and a fastener layer mechanically coupled to the top half of the sheet. The user may dispose the eyeglass on the fastener layer above the metallic bar and fold the rectangular sheet such that the fastener strip engages with the fastener layer, thereby securing the eyeglass within the storage case.

6 Claims, 4 Drawing Sheets

EYEGLASS STORAGE CASE

RELATED APPLICATION

The application claims priority to provisional patent application U.S. Ser. No. 61/749,685 filed on Jan. 7, 2013, the entire contents of which is herein incorporated by reference.

BACKGROUND

The majority of individuals wear some form of eyeglasses during their lives. These eyeglasses may include prescription glasses or sunglasses. These glasses are stored in conventional clamshell type hard cases or sleeves to protect the glasses from dirt and/or damage. However, these cases and sleeves have several limitations that make them impractical and/or ineffective. In particular, although the clamshell hard cases protect the eyeglasses, they are usually bulky and/or difficult to open and close. Often times a user is required to use two hands with opening and closing the case. Sleeves are limited because they are flimsy. Therefore, sleeves do not adequately protect eyeglasses from damage due to an impact.

As such, there is a need in the industry for an eyeglass storage case that overcomes the limitations of the prior art. Specifically, there is a need for a case that adequately protects an eyeglass while allowing a user to easily store and remove the eyeglass from the case.

SUMMARY

An eyeglass storage case configured to conform to contours of the eyeglass in a supported position and allow a user to slidably remove the eyeglass from the storage case is provided. The storage case comprises a rectangular sheet comprising a top half and a bottom half, the top half being mechanically coupled to the bottom half to create a pocket within the rectangular sheet, a support structure disposed within the pocket of the rectangular sheet, the support structure comprising a metallic bar affixed to both a support card and a support layer such that the metallic bar is situated between the card and layer, and oriented perpendicularly to a longitudinal axis of the rectangular sheet, a fastener strip mechanically coupled to an outer portion of the bottom half of the sheet, and a fastener layer mechanically coupled to an outer portion of the top half of the sheet, wherein the user may dispose the eyeglass on the fastener layer above the metallic bar and fold the rectangular sheet such that the fastener strip engages with the fastener layer, thereby securing the eyeglass within the storage case.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
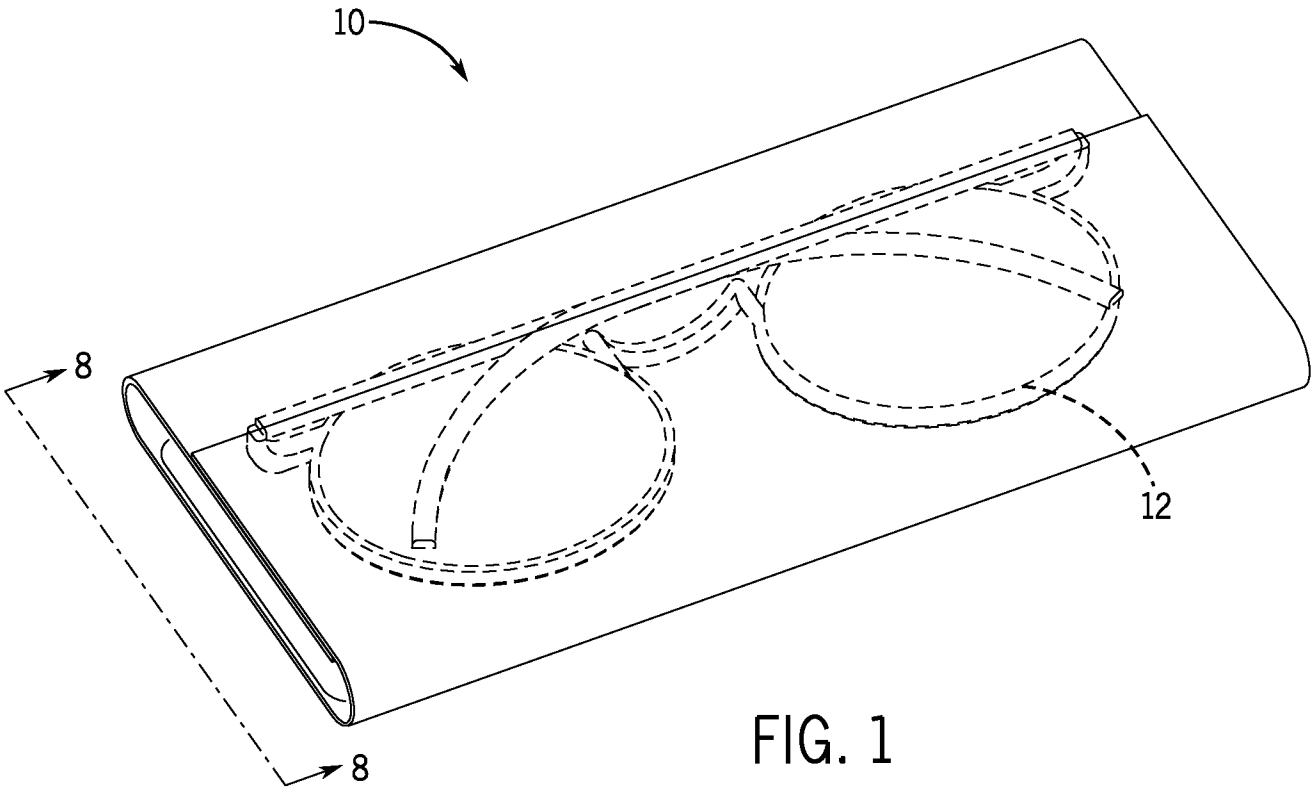
FIG. 1 depicts a perspective view of certain embodiments of the eyeglass storage case.
Figure 2:
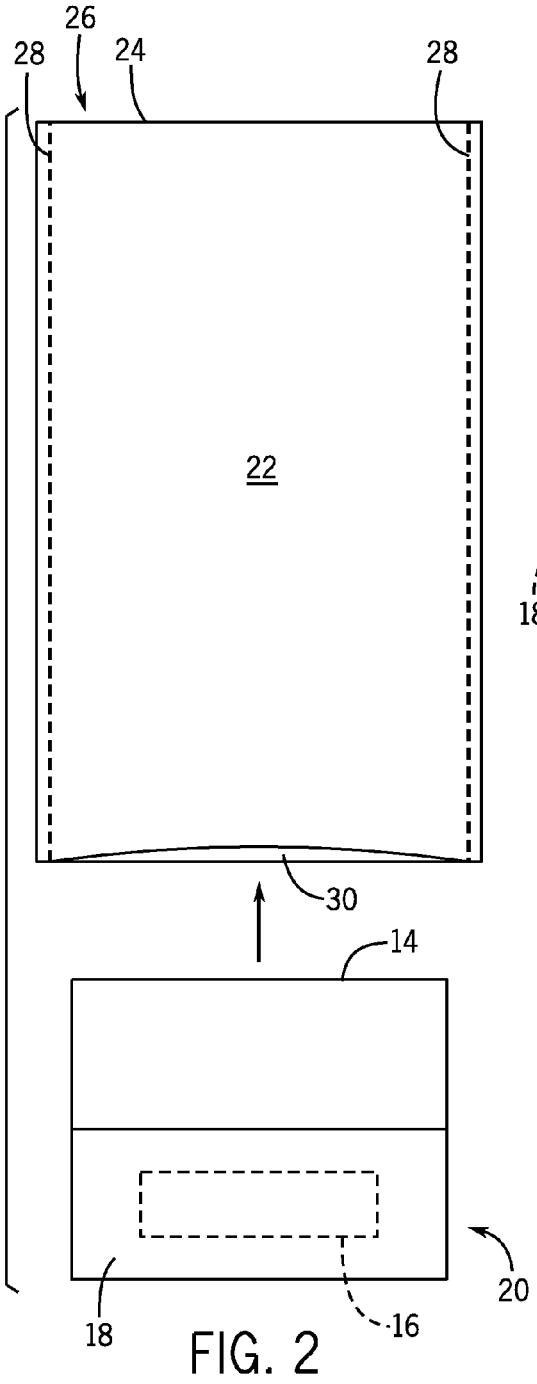
FIG. 2 depicts an exploded top view of certain embodiments of the eyeglass storage case in a first step of assembly.
Figure 3:
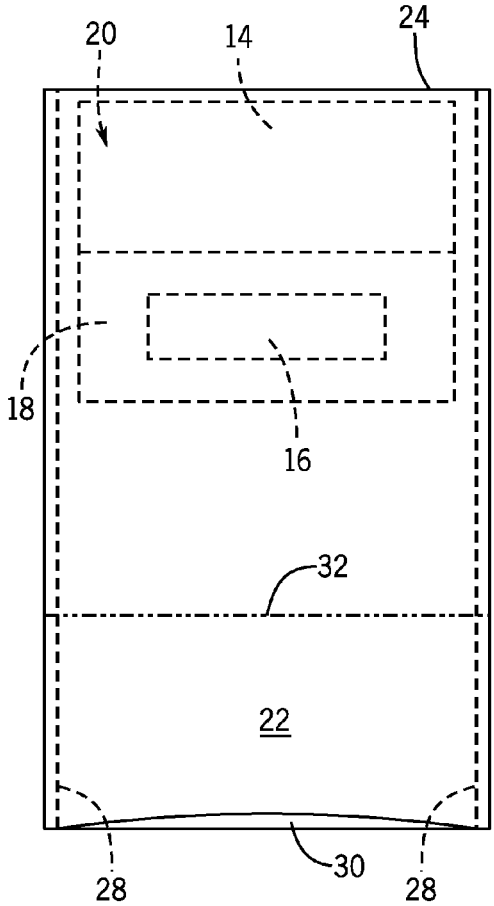
FIG. 3 depicts a top view of certain embodiments of the eyeglass storage case in a second step of assembly.

As depicted in FIG. 1, eyeglass case 10 is designed for use with exemplary eyeglass 12. As depicted in FIGS. 2 and 3, eyeglass case 10 comprises cloth bag 26, which is made from rectangular cloth sheet 22. In a preferred embodiment, cloth sheet 22 has dimensions of approximately 19 inches by 6-6¼ inches. The rectangular cloth sheet 22 is folded in half along first fold line 24. The top half and bottom half of sheet 22 are affixed together by stitching 28 to create a pocket with opening 30. Support structure 20 is inserted within opening 30 such that it is situated within cloth bag 26. It shall be appreciated that support structure 20 may be fastened to the interior of cloth bag 26 using any fastening means known in the field. In an alternative embodiment, cloth bag 26 may be turned inside out prior to the insertion of support structure 20 in the bag. This prevents stitching 28 from being visible on the outside of cloth bag 26.

Support structure 20 comprises foam card 14, foam sponge 18 and metal bar 16. In a preferred embodiment, foam card 14 has dimensions of 5.5 inches ×5.5 inches ×1/16 inch and foam sponge 18 has dimensions of 2.5 inches ×5.5 inches. Metal bar 16 is affixed to both foam card 14 and foam sponge 18 such that the bar is situated between foam card 14 and foam sponge 18. Metal bar 16 may be affixed to foam card 14 and foam sponge 18 by using any known adhesives such as glue. In a preferred embodiment, metal bar 16 is made from aluminum. However, it is understood that any alternative metal may be used. Foam card 14, foam sponge 18 and metal bar 16 provide support to eyeglass case 10 to protect eyeglass 12 from damage from impact. It shall be appreciated that card 14 and sponge 18 may be made from alternative materials or combination of materials including, but not limited to, plastics, paper, or the like.

Figure 4:
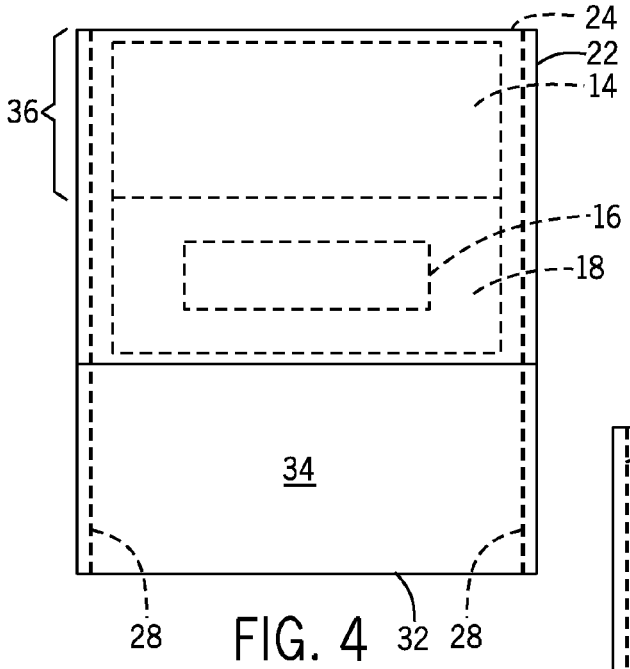
FIG. 4 depicts a top view of certain embodiments of the eyeglass storage case in a third step of assembly.
Figure 5:
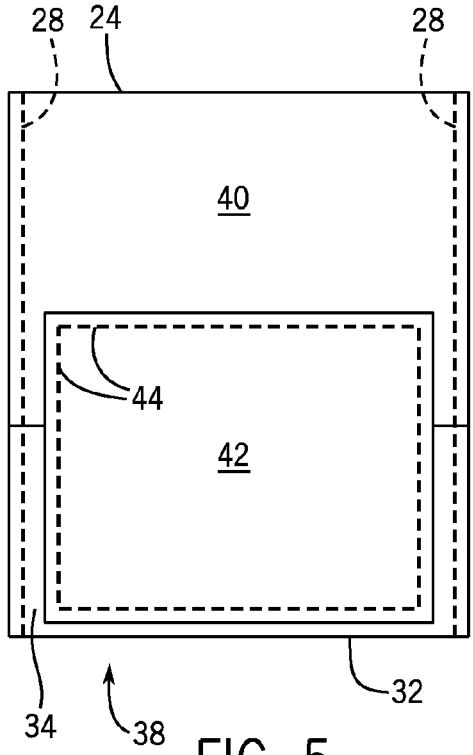
FIG. 5 depicts a top view of certain embodiments of the eyeglass storage case in a fourth step of assembly.
Figure 6:
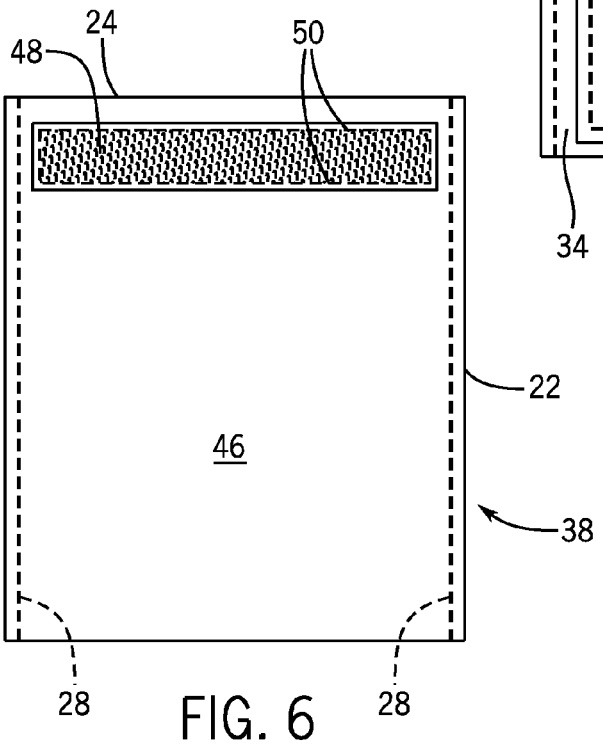
FIG. 6 depicts a bottom view of certain embodiments of the eyeglass storage case in a fifth step of assembly.

As depicted in FIG. 4, the bottom portion of cloth bag 26 is folded along second fold line 32. This creates top flap 36 and bottom flap 34 of cloth bag 26. As depicted in FIG. 5, felt layer 42 is affixed to front face 40 of assembly 38 by stitching 44. Stitching 44 also secures bottom flap 34 of cloth bag 26 in place. As depicted in FIG. 6, fastener 48 is affixed to back face 46 of assembly 38 by stitching 50. In a preferred embodiment, fastener 48 comprises a plurality of hooks. However, it shall be appreciated that any alternative type of fastener known in the field may be used.

Figure 7:
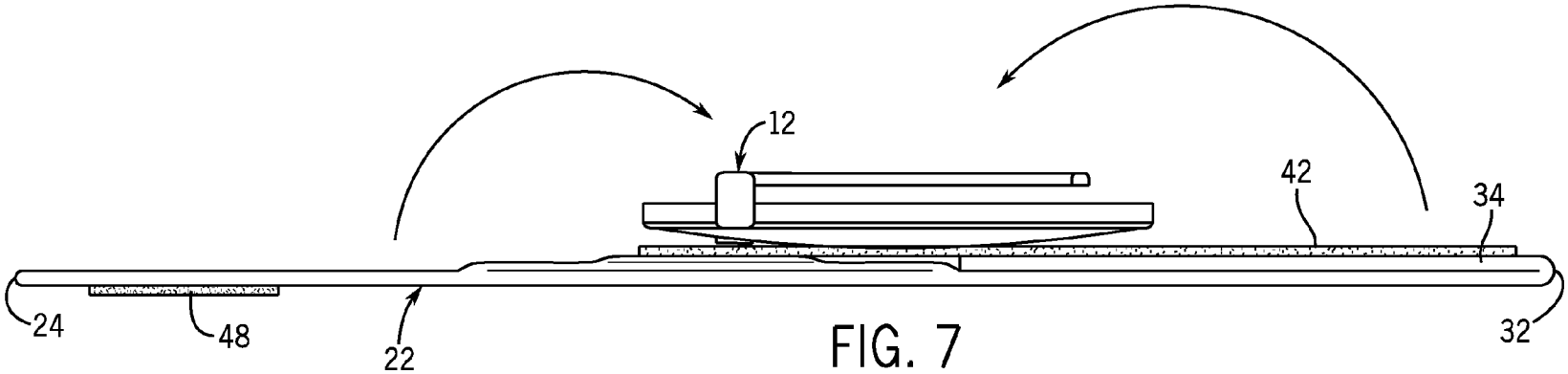
FIG. 7 depicts a side elevation view of certain embodiments of the eyeglass storage case in use in an open position.
Figure 8:
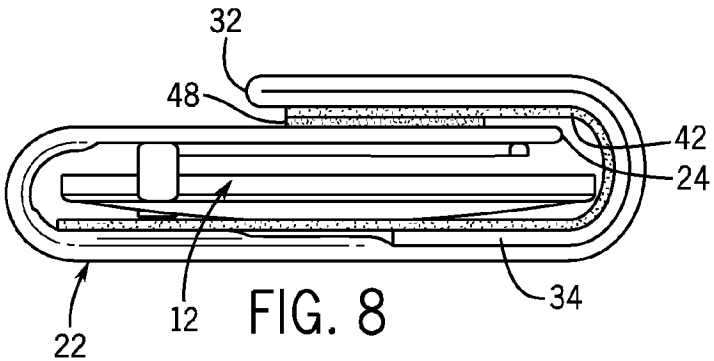
FIG. 8 depicts a side elevation view of certain embodiments of the eyeglass storage case in use in a closed position along line 8-8 of FIG. 1.

As depicted in FIGS. 7 and 8, eyeglass case 10 is shown in use. A user places eyeglass 12 on case 10 face down such that the lenses of eyeglass 12 rest on felt layer 42. In this configuration, eyeglass 12 is positioned above metal bar 16 (not shown). The user folds top flap 36 of eyeglass case 10 over eyeglass 12. This exposes fastener 48 and allows the user to fold bottom flap 34 over fastener 48 such that fastener 48 engages with a portion of felt layer 42. It shall be appreciated that fastener 48 may engage with any portion of felt layer 42 in order to accommodate different sized eyeglasses. As shown in FIG. 8, eyeglass case 10 in the closed position firmly secures eyeglass 12 within eyeglass case 10. Foam card 14, metal bar 16 and foam sponge 18 provide support and protect eyeglass 12 from damage due to an impact. To remove eyeglass 12 from eyeglass case 10, the user uses his/her fingers or hand to push eyeglass 12 such that it slides out the side of the case. Once top flap 36 and bottom flap 34 of case 10 are folded to accommodate a particular sized eyeglass, the user does not have to disengage fastener 48 from felt layer 42 when reinserting eyeglass 12 in the case. The user can simply use his/her hand to slide eyeglass 12 back into case 10. It shall be appreciated that felt layer 42 also serves as a cleaning cloth, which wipes dirt away from the lenses as the user slides eyeglass 12 in and out of case 10.

It shall be appreciated that the components of eyeglass case 10 described in several embodiments herein may comprise any alternative known materials in the field and be of any color, size and/or dimensions. This allows the case to accommodate any variety and size of eyeglasses. It shall be appreciated that the components of the eyeglass case described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An eyeglass storage case configured to conform to contours of the eyeglass in a supported position and allow a user to slidably remove the eyeglass from the storage case, the storage case comprising:

a rectangular sheet comprising a top half and a bottom half, the top half being mechanically coupled to the bottom half to create a pocket within the rectangular sheet;

a support structure disposed within the pocket of the rectangular sheet, the support structure comprising a metallic bar affixed to both a support card and a support layer such that the metallic bar is situated between the card and layer, and oriented perpendicularly to a longitudinal axis of the rectangular sheet;

a fastener strip mechanically coupled to an outer portion of the bottom half of the sheet; and a fastener layer mechanically coupled to an outer portion of the top half of the sheet;

wherein the user may dispose the eyeglass on the fastener layer above the metallic bar and fold the rectangular sheet such that the fastener strip engages with the fastener layer, thereby securing the eyeglass within the storage case.

2. The eyeglass storage case of claim 1, wherein the rectangular sheet is made from cloth.

3. The eyeglass storage case of claim 2, wherein the metallic bar is made from aluminum.

4. The eyeglass storage case of claim 3, wherein the fastener strip comprises hooks.

5. The eyeglass storage case of claim 4, wherein the fastener layer is made from felt.

6. The eyeglass storage case of claim 5, wherein the support card and the support layer are both made from foam.

* * * * *